US006283817B1

(12) United States Patent
Kawaguchi

(10) Patent No.: US 6,283,817 B1
(45) Date of Patent: Sep. 4, 2001

(54) STUFFED TOY

(75) Inventor: Takashi Kawaguchi, Habikino (JP)

(73) Assignee: Kawaguchi Co., Ltd., Habikino (JP)

( * ) Notice: Subject to any disclaimer, the term of this patent is extended or adjusted under 35 U.S.C. 154(b) by 0 days.

(21) Appl. No.: 09/571,850

(22) Filed: May 16, 2000

(30) Foreign Application Priority Data

Aug. 11, 1999 (JP) ..... 11-006072

(51) Int. Cl.[7] ..... A63H 3/28
(52) U.S. Cl. ..... 446/297; 446/397; 446/418
(58) Field of Search ..... 446/297, 298, 446/397, 369, 418, 419, 421, 422

(56) References Cited

U.S. PATENT DOCUMENTS 3,252,242 * 5/1966 Zalkind .
3,528,654 * 9/1970 Larson .
4,266,459 * 5/1981 Seregely .
4,658,694 * 4/1987 Marks et al. .
5,813,899 * 9/1998 Hartley .

* cited by examiner

*Primary Examiner*—Jacob K. Ackun, Jr.
*Assistant Examiner*—Bena B. Miller
(74) *Attorney, Agent, or Firm*—Oblon, Spivak, McClelland, Maier & Neustadt, P.C.

(57) ABSTRACT

A stuffed toy is built with a sound source member, a plate spring, and a stationary plate. The sound source member has the function of producing a sound through its oscillation. One end portion of the plate spring is connected to the sound source member. The stationary plate is attached to part of the plate spring ranging from the other end portion opposite from the above one end portion to a predetermined position, to hold the part of the plate spring. Simply rocking the stuffed toy causes the sound source member to oscillate with the above predetermined position as the fulcrum and then to receive pressure, thereby producing a sound.

16 Claims, 3 Drawing Sheets

STUFFED TOY

BACKGROUND OF THE INVENTION

1. Field of the Invention.

The present invention relates to a stuffed toy producing a sound.

2. Description of the Background Art

Conventionally, various kinds of stuffed toys in the shape of animals and the like as children's toys have been manufactured for sale. Some stuffed toys could even produce a sound.

However, there is no stuffed toy of a simple structure that can produce a sound only by being rocked.

SUMMARY OF THE INVENTION

The present invention is directed to a stuffed toy.

According to an aspect of the present invention, the stuffed toy comprises: a sound source member producing a sound through its oscillation; an elastic member having its one end portion connected to the sound source member; and a stationary member attached to part of the elastic member ranging from the other end portion opposite from the one end portion to a predetermined position, to hold the part of the elastic member.

Despite simplicity in structure, simply rocking the stuffed toy causes the sound material to oscillate, thereby producing a sound.

Preferably, according to another aspect of the present invention, the elastic member is a plate spring.

Preferably, according to still another aspect of the present invention, the elastic member is a coil spring.

An object of the present invention is to provide a stuffed toy of a simple structure that can produce a sound only by being rocked.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
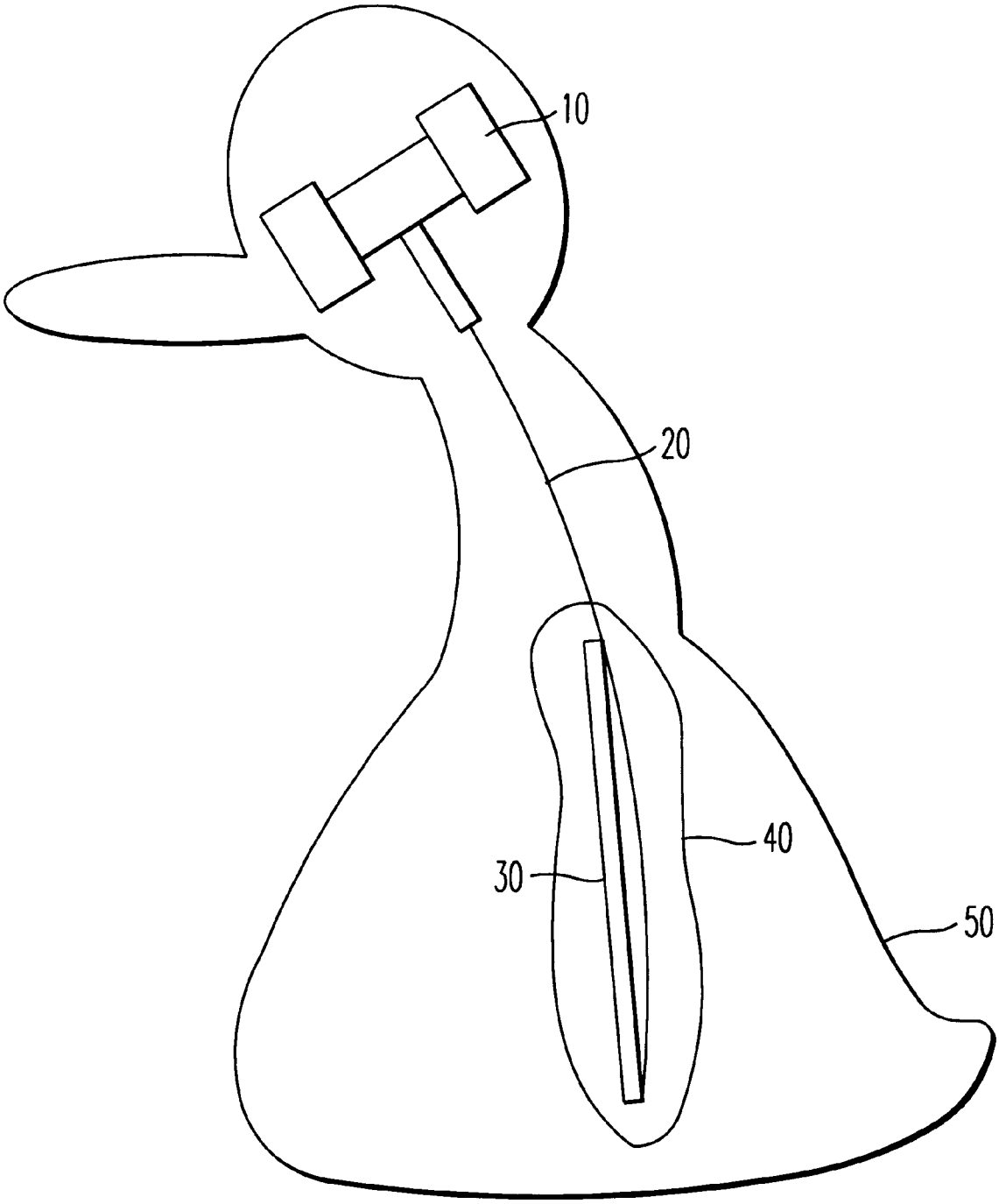
FIG. 1 shows the structure of a stuffed toy according to the present invention.

Now a detailed description of a preferred embodiment of the present invention will be given with reference to the drawings. FIG. 1 shows the structure of a stuffed toy according to the present invention. This stuffed toy comprises a sound source member 10, a plate spring 20, a stationary plate 30, a cover 40, and a coating member 50. The sound source member 10, the plate spring 20, and the stationary plate 30 form a sound producing mechanism.

Figure 2:
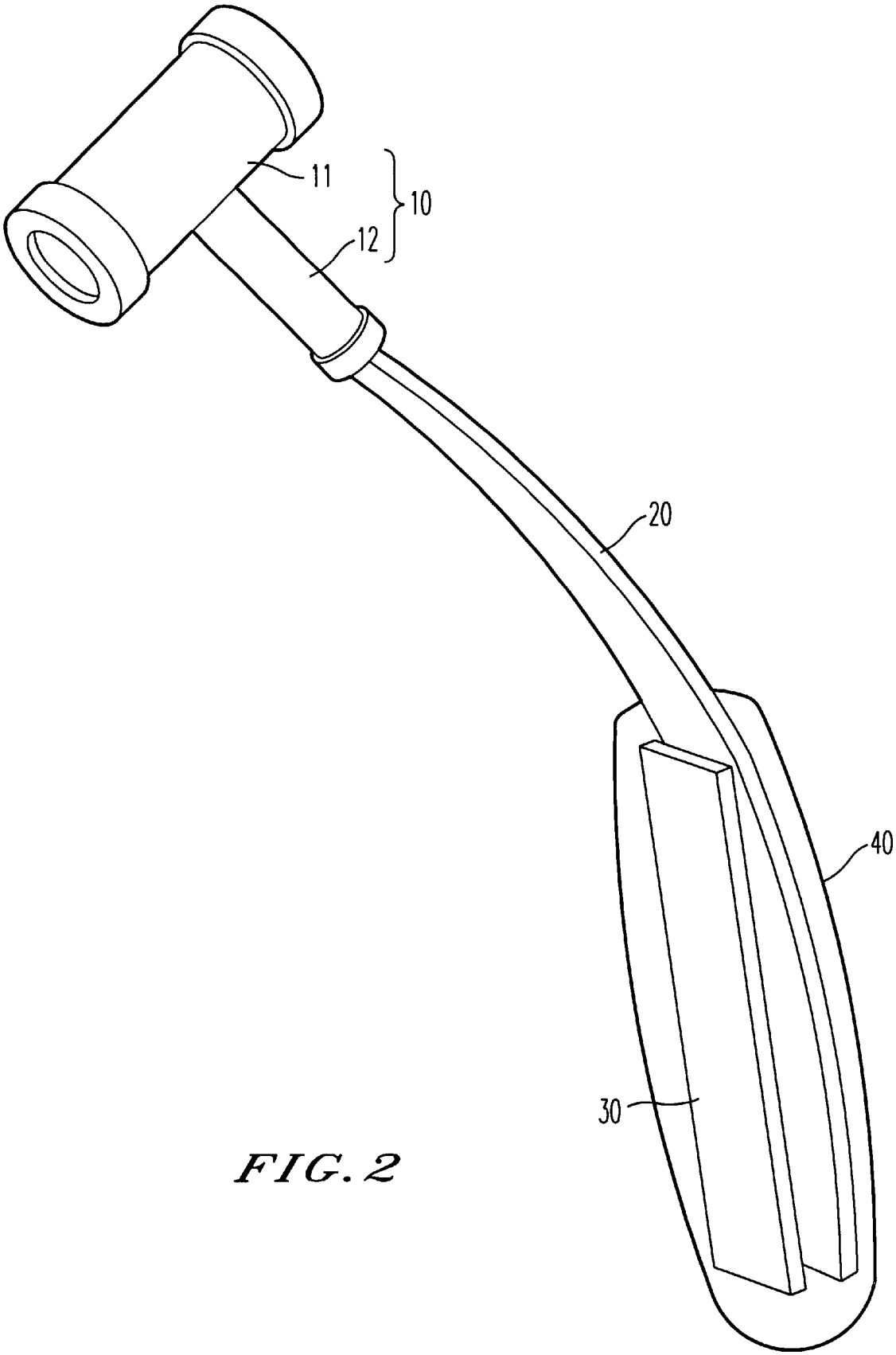
FIG. 2 shows a sound producing mechanism built in the stuffed toy in FIG. 1.

FIG. 2 shows the sound producing mechanism built in the stuffed toy of this preferred embodiment.

The sound source member 10 comprises a whistle member 11 and a supporting part 12. The whistle member 11 is made from resin, having a hollow cylindrical shape. The cylindrical exterior wall of the whistle member 11 takes on a bellows structure; therefore, the whistle member 11 is free to expand and contract along its longitudinal direction. On pressure of its cylindrical end portions, the whistle member 11 contracts longitudinally and produces a sound. Because of its cylindrical external wall having the bellows structure, the whistle member 11 involuntary returns to its original shape after contracted by pressure.

The supporting part 12, being a rodlike member, is secured to the cylindrical periphery of the whistle member 11 to hold the whistle member 11.

The plate spring 20, which is made from spring steel, is a spring using its deflection. One end portion of the plate spring 20 is connected to the supporting part 12, that is, the sound source member 10.

The stationary plate 30 is a plate member, which is secured to the other end portion of the plate spring 20 opposite from the one connected to the sound source member 10 and is also secured at a predetermined position located at a predetermined distance from the above other end portion. That is, the stationary plate 30 is attached to part of the plate spring 20 ranging from the other end portion opposite from the above one end portion to the predetermined position, to hold the part of the plate spring 20.

The stationary plate 30 and the aforementioned part of the plate spring 20 (to which the stationary plate 30 is attached) are covered with the cover 40.

Referring back to FIG. 1, the cover 40 and the sound producing mechanism are totally covered with the coating member 50. The coating member 50, which is made from flocked cloth or the like, is formed into a predetermined shape such as an animal by stitching up to wrap up the sound source member 10, the plate spring 20, the stationary plate 30, and the cover 40 as well as fibers such as cotton.

Rocking the above-structured stuffed toy causes associated oscillations of the sound source member 11 therein. More specifically, since the plate spring 20 from the above other end portion to the predetermined position is secured by the stationary plate 30, spring action of the plate spring 20 causes the sound source member 10 oscillate like a pendulum with the above fixed predetermined position as the fulcrum.

When the stationary plate 30 is not attached to the plate spring 20, the sound source member 10 would not oscillate regularly because of a variable fulcrum of oscillation in the plate spring 20. Further, spring strength of the plate spring 20 varies according to the setting of the predetermined position at which the stationary plate 30 is secured, i.e., the distance of the predetermined position from the above other end portion of the plate spring 20. In other words, the stationary plate 30 defines the spring strength of the plate spring 20 as well as having function of having the plate spring 20 causing the oscillations of the sound source member 10.

When the sound source member 10 oscillates like a pendulum, cotton or the like and the coating member 50 around the sound source member 10 operate in a similar fashion. Then, at the instant when the operating direction of the sound source member 10 is reversed, i.e., when the direction of travel of the sound source member 10 changes from the rightward in FIG. 1 to leftward, the sound source member 10 receives pressure by the application of reaction forces from the surrounding cotton or the like. This causes the whistle member 11 to contract and produce a sound. That is, the sound source member 10 produces a sound upon receipt of pressure through its oscillation. The production of sound lasts intermittently as long as the oscillations of the sound source member 10 continues, that is, as long as the stuffed toy continues to be rocked.

While the stuffed toy of the aforementioned preferred embodiment has a simple structure built only with the sound source member 10, the plate spring 20, and the stationary plate 30, simply rocking the stuffed toy causes the sound member 10 to oscillate and the to receive pressure, thereby producing a sound.

So far one preferred embodiment of the present invention has been described, but it should be understood that the present is not limited only to the above example. For example, the sound producing mechanism is not limited to the example shown in FIG. 2 but it may take the form as shown in FIG. 3.

Figure 3:
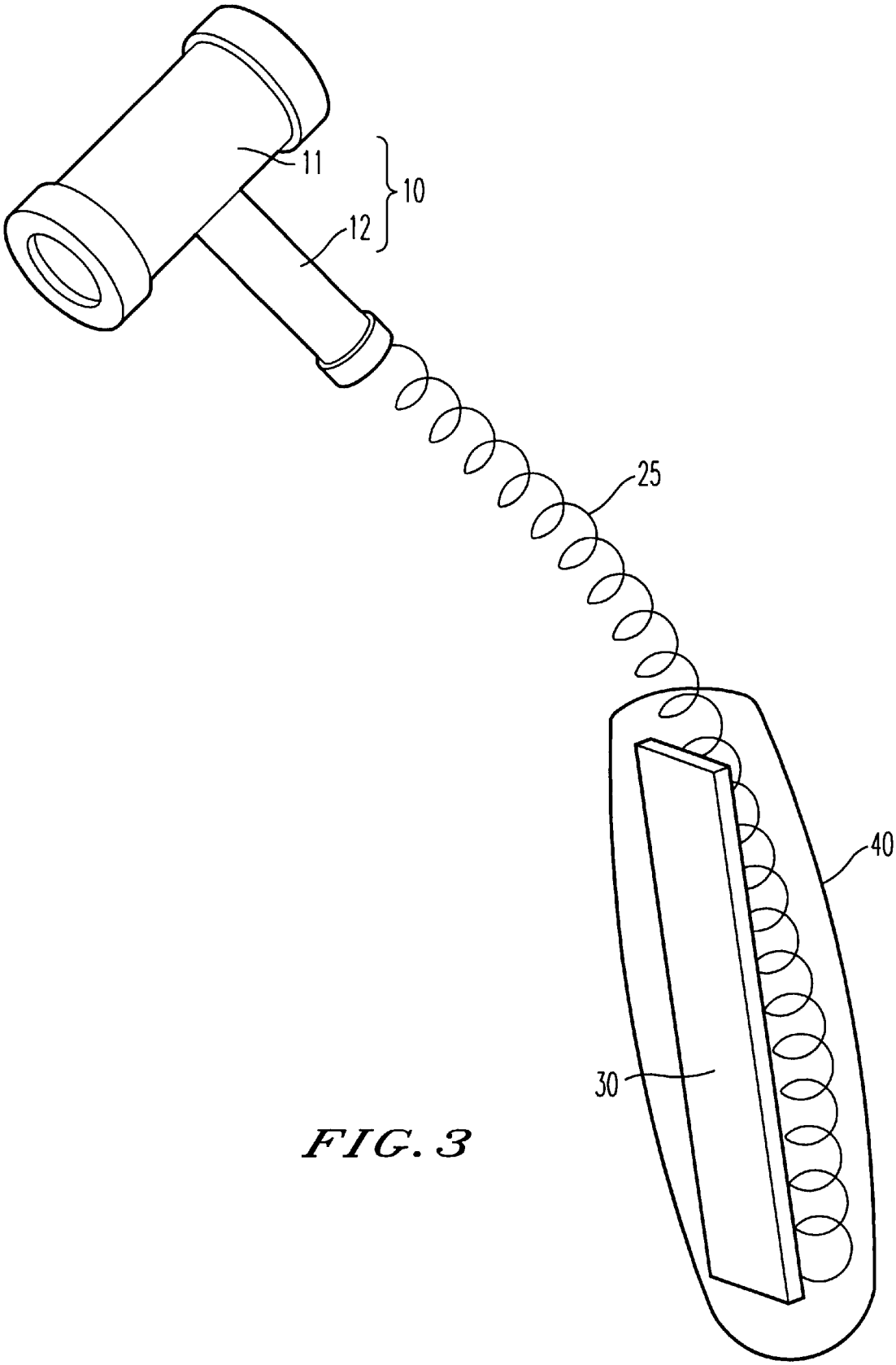
FIG. 3 shows another example of the sound producing mechanism built in the stuffed toy in FIG. 1.

The difference between FIGS. 3 and 2 is that the sound producing mechanism in FIG. 3 uses a coil spring 25 instead of the plate spring 20. The other features thereof are identical to those of the mechanism in FIG. 2, so the description thereof will be omitted.

The coil spring 25 is a helical spring made by winding steel wire in a coil. The form of connections of the sound source member 10 and the stationary plate 30 with the coil spring 25 is similar to that with the aforementioned plate spring 20. The coil spring 25 also has the same function as the plate spring 20.

Thus even if the plate spring 20 is replaced by the coil spring 25, simply rocking the stuffed toy as in the above preferred embodiment causes the sound source member 10 to oscillate and then to receive pressure, thereby producing a sound.

In the above preferred embodiment, the sound source member 10 produces a sound upon receipt of pressure through its oscillation, but it is to be understood that this is not intended to be limiting of the present invention. In fact, one could use any other form as long as sound is produced through oscillation.

While the invention has been shown and described in detail, the foregoing description is in all aspects illustrative and not restrictive. It is therefore understood that numerous modifications and variations can be devised without departing from the scope of the invention.

What is claimed is:

1. A stuffed toy comprising:

a sound source member including a whistle member supported by a supporting part;

an elastic member having first and second end portions, wherein said first end portion is connected to said supporting part of said sound source member; and a stationary member attached to a part of said elastic member, said part of said elastic member ranging from said second end portion, which is located opposite to said first end portion of said elastic member, to a predetermined position, to hold said part of said elastic member, wherein all of said sound source member, said elastic member, and said stationary member make up a sound producing mechanism so that when said sound source member is caused to oscillate back and forth on said elastic member, said whistle member of said sound source member produces a whistling sound.

2. The stuffed toy according to claim 1, wherein said elastic member is a plate spring.

3. The stuffed toy according to claim 2, wherein said stationary member is a stationary plate.

4. The stuffed toy according to claim 3, further comprising a cover enclosing said stationary plate and said part said elastic member, wherein said elastic member is said plate spring.

5. The stuffed toy according to claim 2, wherein said plate spring is made of spring steel.

6. The stuffed toy according to claim 2, wherein said plate spring has a spring strength which varies based upon a distance of said predetermined position at which said stationary member is attached from said second end portion of said elastic member.

7. The stuffed toy according to claim 1, wherein said elastic member is a coil spring.

8. The stuffed toy according to claim 7, wherein said stationary member is a stationary plate.

9. The stuffed toy according to claim 8, further comprising a cover enclosing said stationary plate and said part of said elastic member, wherein said elastic member is said coil spring.

10. The stuffed toy according to claim 1, further comprising a cover enclosing said stationary member and said part of said elastic member.

11. The stuffed toy according to claim 10, further comprising a coating member enclosing said sound source member connected to said elastic member with said part of said elastic member attached to said stationary member covered by said cover.

12. The stuffed toy according to claim 1, wherein said whistle member is made of a resin material.

13. The stuffed toy according to claim 1, wherein said whistle member has a hollow cylindrical shape.

14. The stuffed toy according to claim 13, wherein said whistle member has a cylindrical exterior wall forming a bellows structure so that said whistle member is free to expand and contract along a longitudinal direction of said hollow cylindrical shape thereof.

15. The stuffed toy according to claim 14, wherein when said bellows structure is subjected to pressure on cylindrical end portion thereof, said bellows structure of said whistle member contracts longitudinally and produces said whistling sound.

16. The stuffed toy according to claim 15, wherein said bellows structure of said whistle member involuntarily returns to an original non-contracted state thereof after said pressure on said cylindrical end portion is removed.

* * * * *